United States Patent [19]

Kaloi

[11] 3,972,050

[45] July 27, 1976

[54] END FED ELECTRIC MICROSTRIP QUADRUPOLE ANTENNA

[75] Inventor: Cyril M. Kaloi, Thousand Oaks, Calif.

[73] Assignee: The United States of America as represented by the Secretary of the Navy, Washington, D.C.

[22] Filed: Apr. 24, 1975

[21] Appl. No.: 571,156

[52] U.S. Cl. ..... 343/846; 343/853

[51] Int. Cl.[2] ..... H01Q 1/38

[58] Field of Search ..... 343/769, 846, 854, 853

[56] References Cited

UNITED STATES PATENTS

| | | | |
|---|---|---|---|
| 3,810,183 | 5/1974 | Krutsinger et al. | 343/708 |
| 3,811,128 | 5/1974 | Munson | 343/854 |

*Primary Examiner*—Eli Lieberman

*Attorney, Agent, or Firm*—Richard S. Sciascia; Joseph M. St.Amand

[57] ABSTRACT

An end fed electric microstrip quadrupole antenna consisting of a thin electrically conducting, rectangular-shaped element formed on one surface of a dielectric substrate, the ground plane being on the opposite surface. The feed point is located at one end of the centerline of the antenna length. The antenna bandwidth increases with the width of the element and spacing between the element and ground plane. The end fed microstrip quadrupole antenna operates in a degenerate mode, i.e., two oscillation modes occurring at the same frequency. Along the element length, the oscillation occurs in a dipole mode (fundamental mode) whereas along the element width the oscillation occurs in a quadrupole mode (higher order mode). The corners nearest the feed point may be used for fine tuning of the antenna by trimming small strips of copper from the corner.

6 Claims, 12 Drawing Figures

XY PLANE PLOT 2180 MHz Eø

XZ PLANE PLOT 2180 MHz Eθ

XZ PLANE PLOT 2180 MHz Eø

XY PLANE PLOT 2212 MHz Eø

XZ PLANE PLOT 2212 MHz Eθ

XZ PLANE PLOT 2212 MHz Eø

END FED ELECTRIC MICROSTRIP QUADRUPOLE ANTENNA

This invention is related to copending U.S. patent applications:

Ser. No. 571,154 for DIAGONALLY FED MICROSTRIP DIPOLE ANTENNA;

Ser. No. 571,157 for OFFSET FED MICROSTRIP DIPOLE ANTENNA;

Ser. No. 571,155 for COUPLED FED MICROSTRIP DIPOLE ANTENNA;

Ser. No. 571,152 for CORNER FED MICROSTRIP DIPOLE ANTENNA;

Ser. No. 571,153 for NOTCH FED MICROSTRIP DIPOLE ANTENNA; and

Ser. No. 571,158 for ASYMMETRICALLY FED ELECTRIC MICROSTRIP DIPOLE ANTENNA;

all filed together herewith on Apr. 24, 1975 by Cyril M. Kaloi.

BACKGROUND OF THE INVENTION

This invention relates to antennas and more particularly to a low physical profile antenna that can be arrayed to provide near isotropic radiation patterns.

In the past, numerous attempts have been made using stripline antennas to provide an antenna having ruggedness, low physical profile, simplicity, low cost, and conformal arraying capability. However, problems in reproducibility and prohibitive expense made the use of such antennas undesirable. Older type antennas could not be flush mounted on a missile or airfoil surface. Slot type antennas required more cavity space, and standard dipole or monopole antennas could not be flush mounted.

SUMMARY OF THE INVENTION

The present antenna is one of a family of new microstrip antennas. The specific type of microstrip antenna described herein is the "end fed electric microstrip quadrupole." Reference is made to the "electric microstrip dipole" instead of simply the "microstrip dipole" to differentiate between two basic types; the first being the electric microstrip type, and the second being the magnetic microstrip type. The end fed electric microstrip quadrupole antenna belongs to the electric microstrip type antenna. The electric microstrip antenna consists essentially of a conducting strip called the radiating element and a conducting ground plane separated by a dielectric substrate. The length of the radiating element is approximately ½ wavelength, and the width is approximately one wavelength to get quadrupole action. The conducting ground plane is usually much greater in length and width than the radiating element.

The thickness of the dielectric substrate in the electric microstrip antenna should be much less than ¼ the wavelength. For thickness approaching ¼ the wavelength, the antenna radiates in a monopole mode in addition to radiating in a microstrip mode.

The antenna as hereinafter described can be used in missiles, aircraft and other type applications where a low physical profile antenna is desired. The present type of antenna element provides completely different radiation patterns and can be arrayed to provide near isotropic radiation patterns for telemetry, radar, beacons, tracking, etc. By arraying the present antenna with several elements, more flexibility in forming radiation patterns is permitted. In addition, the antenna can be designed for any desired frequency within a limited bandwidth, preferably below 25 GHz, since the antenna will tend to operate in a hybrid mode (e.g., a microstrip/monopole mode) above 25 GHz for most stripline materials commonly used. However, for clad materials thinner than 0.031 inch higher frequencies can be used. The design technique used for this antenna provides an antenna with ruggedness, simplicity, low cost, a low physical profile, and conformal arraying capability about the body of a missile or vehicle where used including irregular surfaces, while giving excellent radiation coverage. The antenna can be arrayed over an exterior surface without protruding, and be thin enough not to affect the airfoil or body design of the vehicle. The thickness of the present antenna can be held to an extreme minimum depending upon the bandwidth requirement; antennas as thin as 0.005 inch for frequencies above 1,000 MHz have been successfully produced. Due to its conformability, this antenna can be applied readily as a wrap around band to a missile body without the need for drilling or injuring the body and without interfering with the aerodynamic design of the missile.

Advantages of the antenna of this invention over other similar appearing types of microstrip antennas is that the present antenna can be fed very easily from the ground plane side and has a slightly wider banwidth for the same form factor. A wider bandwidth is available in this antenna due to a multiple mode of oscillation being present, i.e., dipole mode and quadrupole mode. The dipole mode of oscillation takes place along the ½ wavelength dimension and the quadrupole mode takes place along the full wavelength dimension of the antenna element.

The end fed electric microstrip quadrupole antenna consists of a thin electrically-conducting, rectangular-shaped element formed on the surface of a dielectric substrate; the ground plane is on the opposite surface of the dielectric substrate and the microstrip antenna element is fed from a coaxial-to-microstrip adapter, with the center pin of the adapter extending through the ground plane and dielectric substrate to the antenna element. The length of the antenna element determines the resonant frequency. The feed point is located at the end on the centerline of the antenna length. The antenna bandwidth increases with the width of the element and the spacing (i.e., thickness of dielectric) between the ground plane and the element; the spacing has a somewhat greater effect on the bandwidth than the element width. The radiation pattern changes very little within the bandwidth of operation.

DESCRIPTION AND OPERATION

Figure 1:
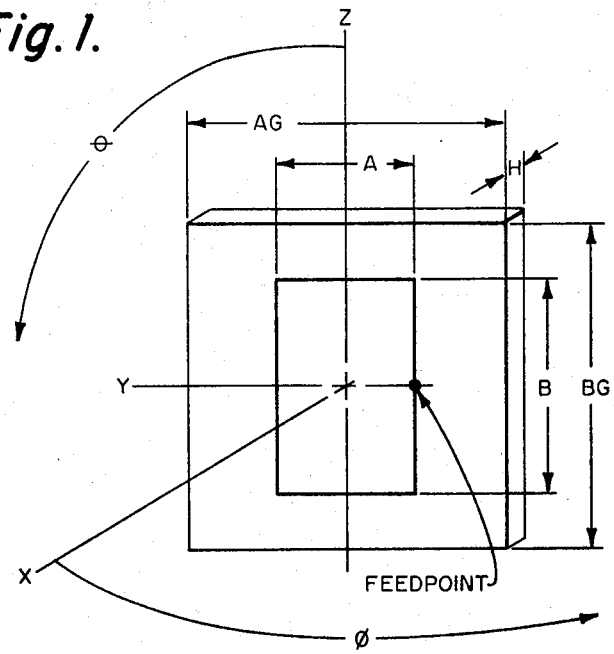
FIG. 1 illustrates the alignment coordinate system used for the asymmetrically fed electric microstrip dipole antenna.

The coordinate system used and the alignment of the antenna element within this coordinate system are shown in FIG. 1. The coordinate system is in accordance with the IRIG Standards and the alignment of the antenna element was made to coincide with the actual antenna patterns that will be shown later. The B dimension is the width of the antenna element. The A dimension is the length of the antenna element. The H dimension is the height of the antenna element above the ground plane and also the thickness of the dielectric. The AG dimension and the BG dimension are the length and the width of the ground plane, respectively. The angles $\theta$ and $\phi$ are measured per IRIG Standards. The above parameters are measured in inches and degrees.

Figure 2A:
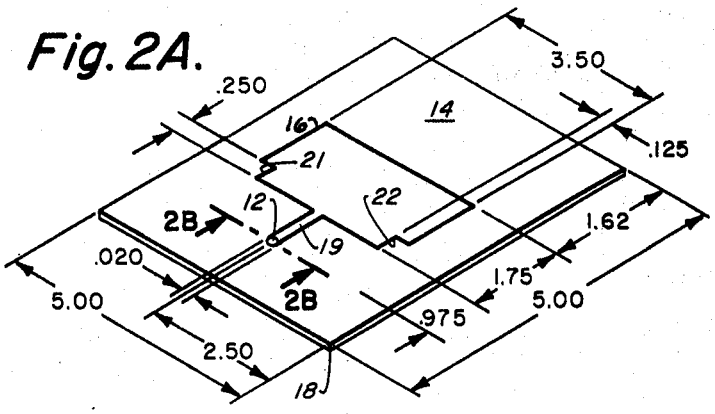
FIG. 2A is an isometric planar view of a typical end fed electric microstrip quadrupole antenna.
Figure 2B:
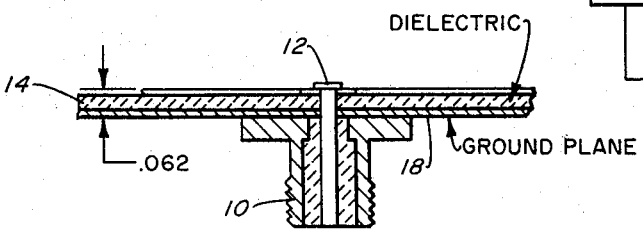
FIG. 2B is a cross-sectional view taken along section line B—B of FIG. 2A.

FIGS. 2A and 2B show a typical end fed electric microstrip quadrupole antenna of the present invention. The typical antenna is illustrated with the dimensions given in inches as shown, by way of example, and the curves shown in later figures are for the typical antenna illustrated. The antenna is fed from a coaxial-to-microstrip adapter 10, with the center pin 12 of the adapter extending through the dielectric substrate 14 and to the feed point for radiating element 16. The microstrip antenna can be fed with most of the different types of coaxial-to-microstrip launchers presently available. The dielectric substrate 14 separates the element 16 from the ground plane 18 electrically.

To get quadrupole action, the antenna element 16 should be approximately one wavelength in width and ½ wavelength in length. The length and width of the element determines the resonant frequency of the antenna, about which more will be mentioned later. It is preferred that both the length and the width of the ground plane be at least one wavelength ($\lambda$) in dimension beyond each edge of the element to minimize backlobe radiation.

If the antenna is fed at the end, the input impedance for most practical antenna elements is usually high compared to most source impedances. In this case, a matching microstrip transmission line 19, as shown in FIGS. 2A and 2B, is used to match the element to the lower source impedances.

Figure 3:
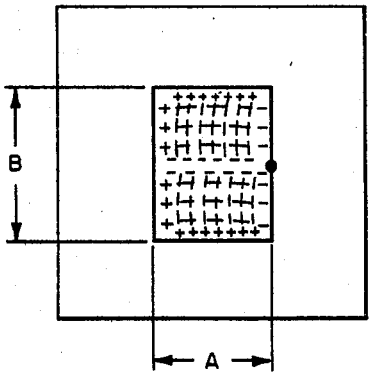
FIG. 3 illustrates the general configuration of electric field distribution for an electric microstrip quadrupole antenna.

The end fed microstrip quadrupole antenna operates in a degenerate mode, i.e., two oscillation modes occurring at the same frequency. These oscillations occur along the Y axis (A dimension) and also along the Z axis (B dimension). Along the A dimension the oscillation occurs in a dipole mode (fundamental mode) whereas along the B dimension the oscillation occurs in the quadrupole mode (higher order mode). FIG. 3 depicts the radiation field configuration for these two modes of oscillation.

Figure 4:
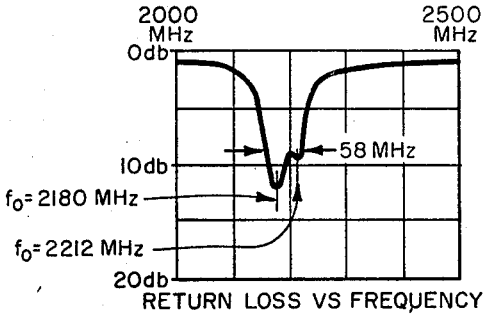
FIG. 4 is a plot showing the return loss versus frequency for an antenna having the dimensions shown in FIGS. 2A and 2B.

Dimension A determines the resonant frequency of the dipole mode of oscillation and dimension B determines the resonant frequency of the quadrupole mode of oscillation. The corners nearest the feed point may be used for fine tuning of the antenna. This is accomplished by trimming small strips of copper from the corners, such as shown at 21 and 22 in FIG. 2A. Strips that are removed parallel to the A dimension tunes the oscillation along the B dimension and strips that are removed parallel to the B dimension tunes the oscillation along the A dimension. Multimode oscillation in this type of antenna is not undesirable. In fact, it is sometimes desirable to have these two modes resonate at two different but closely spaced frequencies and thereby increase the bandwidth of the antenna. A plot of return loss versus frequency for the antenna configuration shown in FIGS. 2A and 2B is shown in FIG. 4. The plot in FIG. 4 gives an indication of the bandwidth and also shows the two resonant frequencies at 2212 MHz and 2180 MHz. The 2212 MHz resonance is due to the dipole oscillation whereas the 2180 MHz resonance is due to the quadrupole resonance. The difference between the above mentioned modes may be determined by observing the radiation patterns shown in FIGS. 5 through 10 and also the field distribution shown in FIG. 3.

Figure 5:
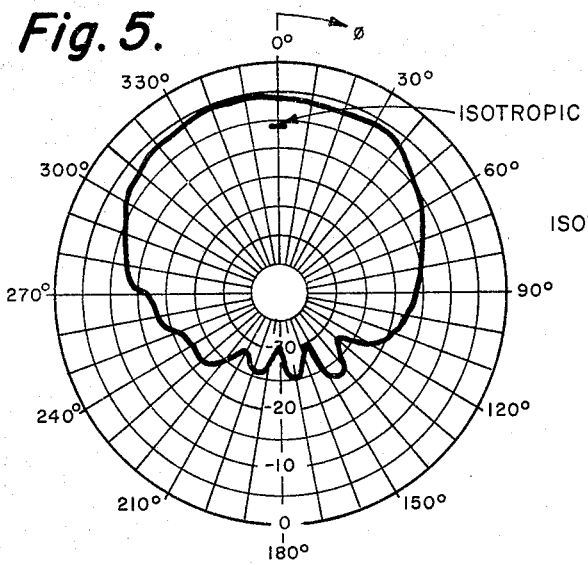
FIG. 5 shows the antenna radiation pattern (XY-Plane plot) due to the dipole mode at 2180 MHz for the antenna shown in FIGS. 2A and 2B.
Figure 6:
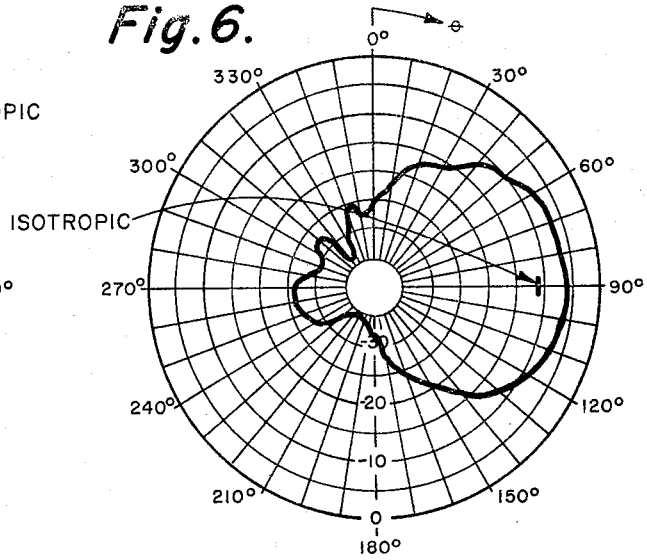
FIG. 6 shows the antenna radiation pattern (XZ-Plane plot) due to the dipole mode at 2180 MHz for the antenna shown in FIGS. 2A and 2B.
Figure 7:
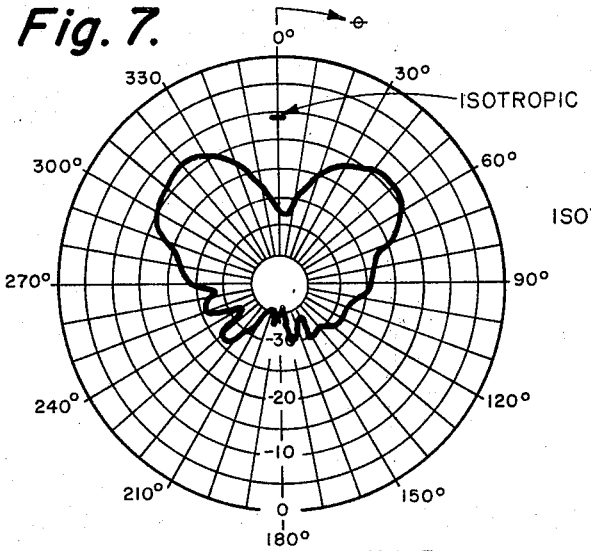
FIG. 7 shows the antenna radiation pattern (XZ-Plane plot) due to the quadrupole mode when resonating at 2180 MHz for the antenna shown in FIGS. 2A and 2B.
Figure 8:
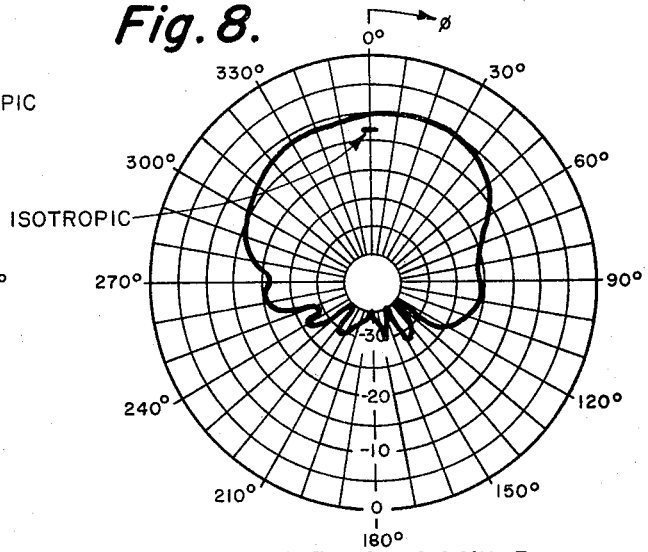
FIG. 8 shows the antenna radiation pattern (XY-Plane plot) due to the dipole mode at 2212 MHz for the antenna shown in FIGS. 2A and 2B.
Figure 9:
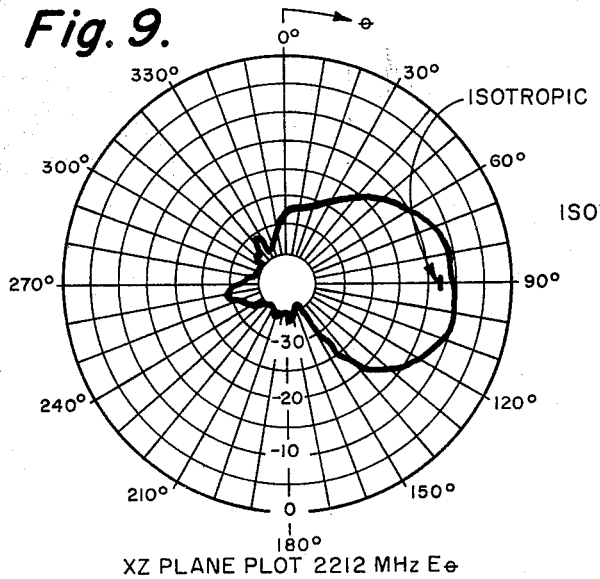
FIG. 9 shows the antenna radiation pattern (XZ-Plane plot) due to the dipole mode at 2212 MHz for the antenna shown in FIGS. 2A and 2B.
Figure 10:
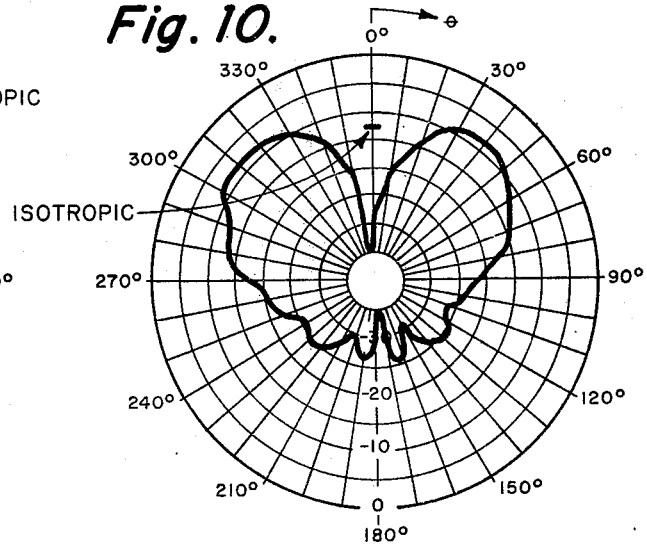
FIG. 10 shows the antenna radiation pattern (XZ-Plane plot) due to the quadrupole mode when resonating at 2212 MHz for the antenna shown in FIGS. 2A and 2B.

FIG. 5 and FIG. 6 show antenna radiation patterns, for the typical antenna shown in FIGS. 2A and 2B, due to the dipole mode. FIG. 7 shows a radiation pattern due to the quadrupole mode when resonating at 2180 MHz. FIGS. 8 through 10 show similar plots when resonating at 2212 MHz. It can be observed that at 2212 MHz both modes show approximately the same level of radiation, whereas at 2180 MHz, the dipole mode predominates. When using the above technique for increasing bandwidth one should not separate the resonant frequencies to the point where one mode predominates in the emitted radiation level, since this will cause variation in the radiation pattern over the desired bandwidth.

One of the outstanding features of this antenna is the combination of the quadrupole radiation pattern and the dipole radiation pattern in one element. The quadrupole pattern is essentially the same as an annular slot, where the pattern takes the shape of a donut laying on its side. In this case, there is some lifting of the pattern due to ground plane effects such that the maximum radiation occurs approximately at 45° from the horizontal instead of at the horizontal. The dipole mode is essentially the same as a slot in a ground plane, in this case the H-Plane plot shows a narrower beam width.

As a two element array for telemetry on a missile, this antenna configuration is almost optimum. The scheme of such an array would entail an element at top dead center of a missile and one at bottom dead center of the missile, with a 180° phase difference between the two elements. The A dimension of the element would be aligned parallel to the axis of the missile. For this case one would observe mostly vertical polarization over most of the missiles sphere of radiation. Such a radiation pattern configuration is desirable, since horizontal radiation is more susceptible to multipath problems compared to vertical polarization. The small amount of horizontal polarization is due to the narrow beam H-Plane radiation of the dipole mode.

Figure 11:
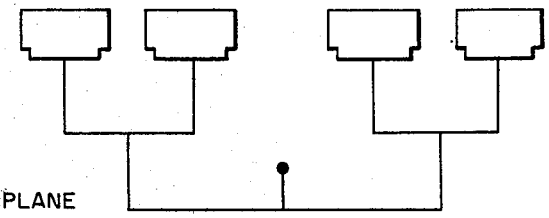
FIG. 11 shows a general configuration for arraying a plurality of antenna elements with microstrip transmission line.

An array of four end fed microstrip quadrupole elements is diagrammatically shown in FIG. 11. A two element array, as discussed above, is shown on either half of FIG. 11. Only E-Plane (XY-Plane) plots and H-Plane (XZ-Plane) plots are shown in FIGS. 5–10. Cross-polarization energy is minimal and is therefore not included. The E-Plane plot is the measurement made in the plane parallel to the E field (i.e., polarization field). The H-Plane plot is the measurement made normal to the E field. Note that the beam width narrowing effects are due to ground plane effects.

The antenna is fed at the end of the element length on the center-line, a matching transmission line 19 is required since the input impedance will be very high for most practical microstrip antennas.

Obviously many modifications and variations of the present invention are possible in the light of the above teachings. It is therefore to be understood that within the scope of the appended claims the invention may be practiced otherwise than as specifically described.

I claim:

1. An end fed electric microstrip quadrupole antenna having low physical profile and conformal arraying capability, comprising:

a. a thin ground plane conductor;

b. a thin rectangular radiating element spaced from said ground plane;

c. said radiating element being electrically separated from said ground plane by a dielectric substrate;

d. said radiating element having a feed point located at the end of the length on the centerline thereof;

e. said radiating element being fed from a coaxial-to-microstrip adapter, the center pin of said adapter extending through said ground plane and dielectric substrate to said radiating element;

f. the length of said radiating element determining the resonant frequency of said antenna; the length of said radiating element being approximately one-half wavelength and the width being approximately one wavelength to provide quadrupole action;

g. said antenna operating in a degenerate mode with two oscillation modes occurring at the same frequency, oscillation in a dipole mode occurring along the length of the element and oscillation in a quadrupole mode occurring along the width of the element;

h. the antenna bandwidth being variable with the width of the radiating element and the spacing between said radiating element and said ground plane, said spacing between the radiating element and the ground plane having somewhat greater effect on the bandwidth than the element width.

2. An antenna as in claim 1 wherein the ground plane conductor extends at least one wavelength in each direction beyond the edges of the antenna element to minimize any possible backlobe radiation.

3. An antenna as in claim 1 wherein the corners of said thin radiating element nearest said feed point being used for fine tuning said antenna by trimming small strips from said corners.

4. An antenna as in claim 1 wherein a plurality of said radiating elements are arrayed to provide a near isotropic radiation pattern.

5. An antenna as in claim 1 wherein the antenna input impedance is matched to most practical impedances by matching microstrip transmission line without affecting the antenna radiation pattern.

6. An antenna as in claim 1 wherein said thin radiating element is formed on one surface of said dielectric substrate.

* * * * *